US007102108B2

(12) United States Patent
Kikuchi et al.

(10) Patent No.: US 7,102,108 B2
(45) Date of Patent: Sep. 5, 2006

(54) INDUCTION-HEATING APPARATUS OPERATING WITH POWER SUPPLIED IN A SELECT FREQUENCY RANGE

(75) Inventors: Kazuhiko Kikuchi, Yokohama (JP); Kazushige Morihara, Yokohama (JP); Satoshi Kinouchi, Tokyo (JP); Osamu Takagi, Tokyo (JP); Shin Yamauchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 71 days.

(21) Appl. No.: 10/799,770

(22) Filed: Mar. 15, 2004

(65) Prior Publication Data

US 2005/0199612 A1 Sep. 15, 2005

(51) Int. Cl.
*H05B 6/14* (2006.01)
*G03G 15/20* (2006.01)

(52) U.S. Cl. ..... 219/619; 219/670; 219/663; 399/328; 399/330

(58) Field of Classification Search ..... 219/619, 219/670, 660–669; 399/328–335
See application file for complete search history.

(56) References Cited

U.S. PATENT DOCUMENTS

| | | | | |
|---|---|---|---|---|
| 4,675,487 | A * | 6/1987 | Verkasalo | 219/619 |
| 6,026,273 | A | 2/2000 | Kinouchi et al. | |
| 6,321,046 | B1 | 11/2001 | Kikuchi et al. | |
| 6,377,778 | B1 | 4/2002 | Kikuchi et al. | |
| 6,522,846 | B1 | 2/2003 | Kinouchi et al. | |
| 6,573,485 | B1 * | 6/2003 | Yokozeki | 219/619 |

FOREIGN PATENT DOCUMENTS

| | | |
|---|---|---|
| JP | 3-34286 A | 2/1991 |
| JP | 8-76620 A | 3/1996 |
| JP | 9-80951 A | 3/1997 |
| JP | 9-258586 A | 10/1997 |
| JP | 2003-7446 A | 1/2003 |

* cited by examiner

*Primary Examiner*—Philip H. Leung
(74) *Attorney, Agent, or Firm*—Foley & Lardner LLP

(57) ABSTRACT

An excitation coil and/or a core member, which has a characteristic frequency other than frequencies used, is employed. Thereby, resonance is prevented between adjacent coils or between a coil and an adjacent component such as a core member.

10 Claims, 6 Drawing Sheets

INDUCTION-HEATING APPARATUS OPERATING WITH POWER SUPPLIED IN A SELECT FREQUENCY RANGE

BACKGROUND OF THE INVENTION

1. Field of the Invention

The present invention relates to a heating device that produces heat by making use of induction heating, and a fixing unit in which the heating device is mounted.

2. Description of the Related Art

A heating device using induction heating is employed in a fixing device that is mounted in an electrophotographic copying machine.

As is disclosed in, for instance, Jpn. Pat. Appln. KOKAI Publication No. 9-258586, in this kind of heating method, eddy current is caused in a fixing (heating) roller, using a coil that is wound around a core extending along the rotational axis of the roller. Thus, the roller is heated.

Jpn. Pat. Appln. KOKAI Publication No. 8-76620 discloses a heating device wherein magnetic field generating means applies a magnetic field to a heating belt so that the heating belt produces heat by induction heating. The heating belt is clamped between a pressing belt and the field generating means, thus forming a nip.

In this type of heating device using induction heating, radio frequency (RF) power is supplied to the excitation coil, thereby to quickly raise the temperature up to a level that is needed for fixation. As a result, resonance noise is produced due to resonance of the excitation coil.

Consequently, there arises such a problem that a holder member that holds the excitation coil, or a coil unit that includes a magnetic core for enhancing magnetic flux may be damaged.

BRIEF SUMMARY OF THE INVENTION

The present invention can provide a heating device using induction heating, which can prevent resonance of an excitation coil and can prevent damage to other device components disposed near the excitation coil.

According to an aspect of the present invention, there is provided a heating device comprising: a coil with a predetermined characteristic frequency; a control section that supplies power with a predetermined frequency to the coil; and an electrically conductive member that produces heat by a magnetic field that is generated by the coil, which is supplied with predetermined power from the control section, wherein the predetermined characteristic frequency of the coil differs from a range of frequencies of voltage and current that are output from the control section.

According to another aspect of the present invention, there is provided a heating device comprising: a first coil that has a first inductance and is supplied with power having a first frequency; a second coil that has a second inductance and is supplied with power having a second frequency; a control section that supplies predetermined powers to the first and second coils at a predetermined timing; and an electrically conductive member that produces heat by a magnetic field that is generated by the first and second coils, which are supplied with the predetermined powers from the control section, wherein the control section supplies power of the first frequency to the first coil, and power of the second frequency to the second coil.

According to further another aspect of the present invention, there is provided a heating device comprising: a coil that is supplied with predetermined power and generates a predetermined magnetic field; a core member with a predetermined characteristic frequency, the core member being disposed near the coil; a control section that supplies power with a predetermined frequency to the coil; and an electrically conductive member that produces heat by a magnetic field that is generated by the coil, which is supplied with the predetermined power from the control section, wherein the predetermined characteristic frequency of the coil differs from a range of frequencies of voltage and current that are output from the control section.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of an aspect of the invention.

DETAILED DESCRIPTION OF THE INVENTION

An example of a fixing unit according to an embodiment of the present invention will now be described with reference to the accompanying drawings.

Figure 1:
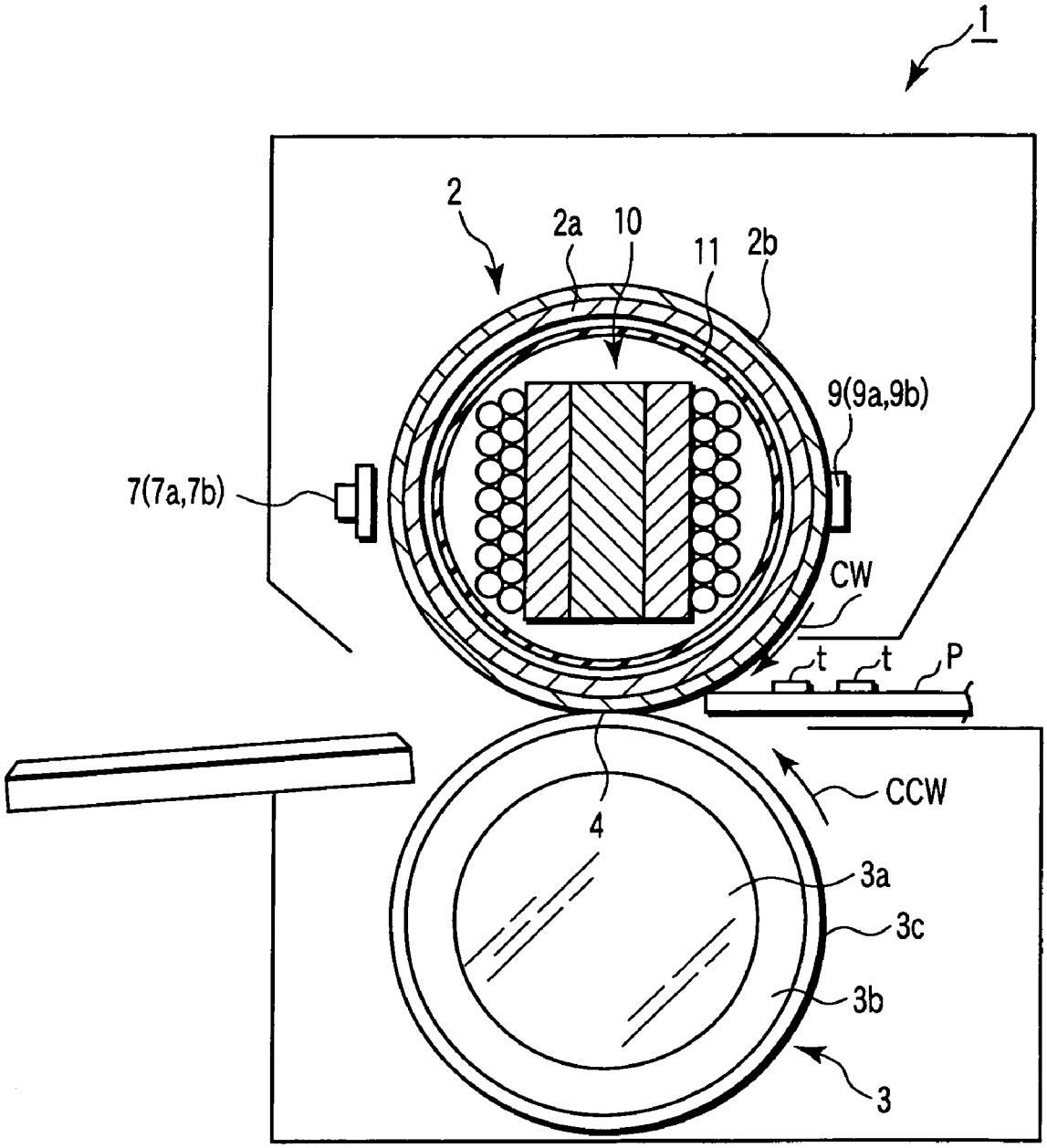
FIG. 1 schematically shows an example of a fixing unit in which a heating device according to the present invention is disposed.

As is shown in FIG. 1, a fixing unit 1 includes a fixing (heating) roller 2, a press roller 3, an abnormal heating sensor 7, a temperature sensor 9, magnetic field generating means 10 and an insulation sheet 11.

The heating roller 2 includes an electrically conductive member 2*a* that has a hollow cylindrical shape and is formed of a metal. The conductive member 2*a* has a thickness of about 0.5 to 3.0 mm, preferably about 1.5 mm. It is preferable that the outside diameter of the conductive member 2*a* be $\phi$=60 mm. In this embodiment, the heating roller 2 is made of ion. Alternatively, the heating roller 2 may be formed of, for instance, stainless steel, nickel, aluminum, or an alloy of stainless steel and aluminum. The surface of the conductive member 2*a* is provided with a releasing layer 2*b* that has a predetermined thickness and is formed of a fluoro-resin, typically tetrafluoroethylene (TFE).

The press roller 3 includes a metal core 3*a*, which is a metallic shaft with a high rigidity or a rigidity that does not permit deformation under predetermined pressure; silicone rubber 3*b* provided around the metal core 3*a*; and fluoro-rubber 3*c*. It is preferable that the outside diameter of the press roller be ϕ=60 mm.

The press roller 3 receives an urging force from a pressing mechanism (not shown), thereby applying a predetermined pressure to the heating roller 2. By this pressure, a nip 4 is formed. The nip 4 has a predetermined nip width in a direction perpendicular to the axis of the press roller 3.

The heating roller 2 is rotated in the direction of an arrow (CW) by a driving motor (not shown). With this rotation, the press roller 3 is rotated in the direction of an arrow (CCW).

The abnormal heating sensor 7 comprises thermostats, for instance. The sensor 7 detects abnormal heating when the surface temperature of the heating roller 2 rises abnormally. In case abnormal heating occurs, power supply to the magnetic field generating means 10 (excitation coils), which is described later, is stopped. As will be described later with reference to FIG. 6, the abnormal heating sensor 7 comprises a temperature detection element 7*a* that is disposed substantially at a midpoint in the longitudinal direction of the roller 2, and a temperature detection element 7*b* that is disposed at one end in the longitudinal direction of the roller 2. A plurality of sensors 7, e.g. two sensors 7, may be provided.

The temperature sensor 9 comprises thermistors, for instance. The sensor 9 detects the temperature of the outer periphery of the heating roller 2. The temperature sensor 9 comprises a temperature detection element 9*a* that is disposed substantially at a midpoint in the longitudinal direction of the roller 2, and a temperature detection element 9*b* that is disposed at one end in the longitudinal direction of the roller 2. A plurality of temperature sensors 9, e.g. two sensors 9, may be provided.

The order of arrangement and the positions of the abnormal heating sensor 7*a*, 7*b* and temperature sensor 9*a*, 9*b* are not limited to those shown in FIG. 1.

The magnetic field generating means 10 is disposed within the heating roller 2.

The insulation sheet 11 is disposed between the heating roller 2 and the magnetic field generating means 10. The insulation sheet 11 effects insulation between the inner peripheral surface of the heating roller 2 and the magnetic field generating means 10.

The insulation sheet 11 needs to have a heat-resistance temperature that is higher than a highest temperature of the heating roller 2, which is heated by induction heating when predetermined power is fed to the magnetic field generating means 10. In addition, the insulation sheet 11 needs to have a power resistance that can withstand a maximum power (voltage and current), which is supplied to the magnetic field generating means 10. Taking these requirements into account, it is preferable that the insulation sheet 11 have a contraction ratio of 2% or less and a thickness of 0.4 mm or more under the condition in which the temperature of the heating roller 2 takes a highest value.

In the present embodiment, the insulation sheet 11, which meets the above requirements, is formed of PFA (perfluoroalkoxy alkan). Alternatively, PTFE (polytetrafluoroethylene), etc. may be used if the above conditions of heat-resistance temperature and power resistance are satisfied.

Figure 2:
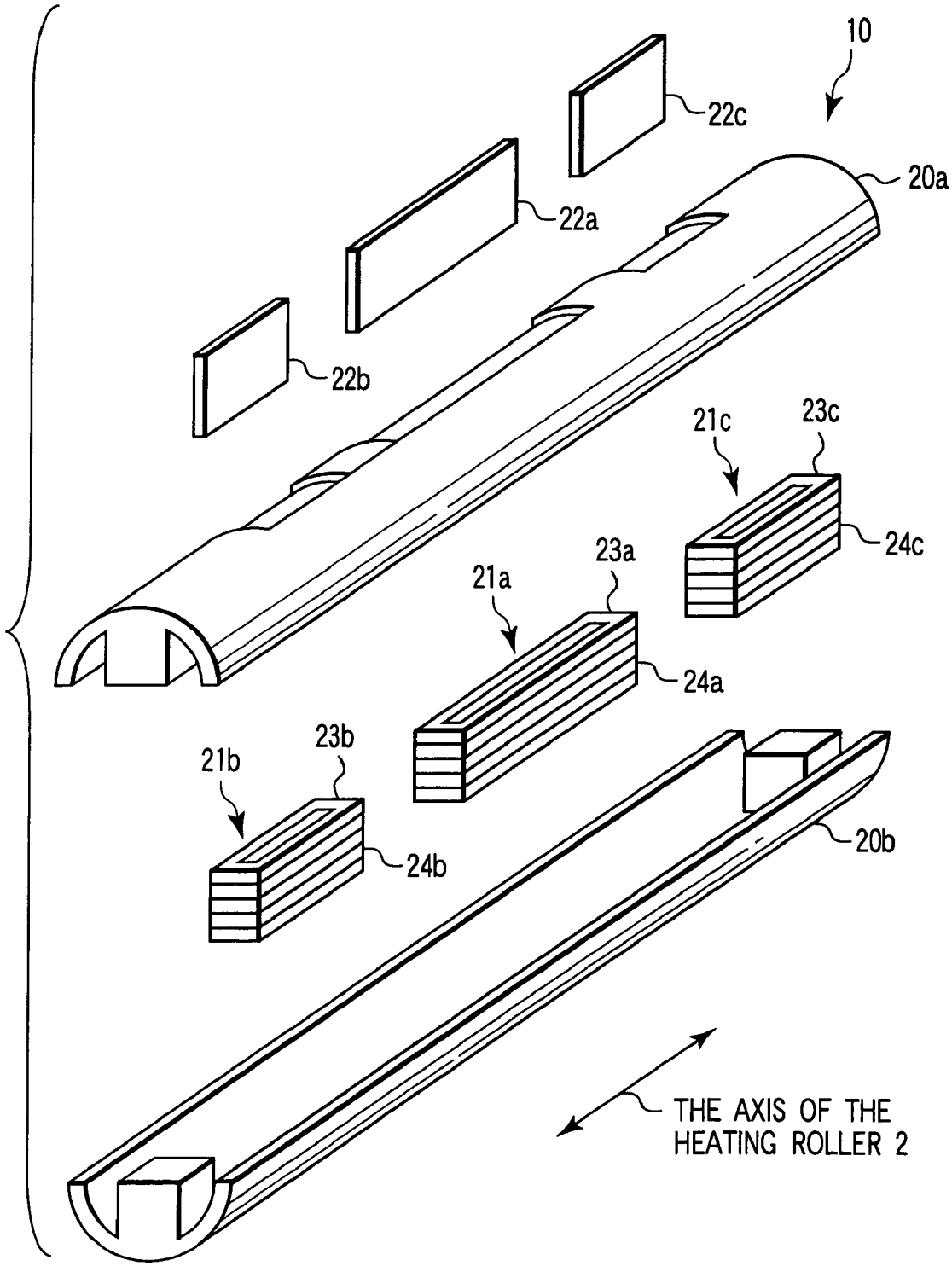
FIG. 2 schematically shows an example of a heating device that is applicable to the fixing unit shown in FIG. 1.

FIG. 2 is an exploded perspective view that schematically shows an example of the structure of the magnetic field generating means 10 in the state prior to assembly.

The magnetic field generating means 10 includes holders 20*a* and 20*b*, and coil units 21*a*, 21*b* and 21*c*. The coil unit 21*a* includes a core member 22*a*, a coil bobbin 23*a* and an excitation coil 24*a*. The coil unit 21*b* includes a core member 22*b*, a coil bobbin 23*b* and an excitation coil 24*b*. The coil unit 21*c* includes a core member 22*c*, a coil bobbin 23*c* and an excitation coil 24*c*.

The holders 20*a* and 20*b* vertically sandwich the coil units 21*a*, 21*b* and 21*c* and hold them in proper positions. The holders 20*a* and 20*b* may be formed of the same components, that is, components that have the same structure and are formed of the same material.

The coil unit 21*a* is disposed at a midpoint in the axial direction of the heating roller 2. The coil unit 21*a* includes the coil bobbin 23*a* and the excitation coil 24*a* that is wound around the coil bobbin 23*a*.

The coil units 21*b* and 21*c* are disposed at both sides of the coil unit 21*a*, that is, at both axial ends of the heating roller 2. The coil unit 21*b* includes the excitation coil 24*b* that is wound around the coil bobbin 23*b*, and the coil unit 21*c* includes the excitation coil 24*c* that is wound around the coil bobbin 23*c*.

The core members 22*a*, 22*b* and 22*c* have rectangular shapes with predetermined sizes, and are disposed inside the coil bobbins 23*a*, 23*b* and 23*c*, respectively. In the present embodiment, the core members are formed of ferrite or laminated steel plates. Alternatively, they may be formed essentially of, e.g. dust cores with low loss in radio-frequency ranges.

Preferably, the holders 20*a* and 20*b* and coil bobbins 23*a*, 23*b* and 23*c* should be formed of, e.g. a resin material with high heat resistance and high insulation properties. Examples of the material of the holders 20*a* and 20*b* and coil bobbins 23*a*, 23*b* and 23*c* include liquid crystal polymers, engineering plastics, ceramics, PEEK (polyether-ether-ketone) materials, phenolic materials, and unsaturated polyesters.

Figure 3:
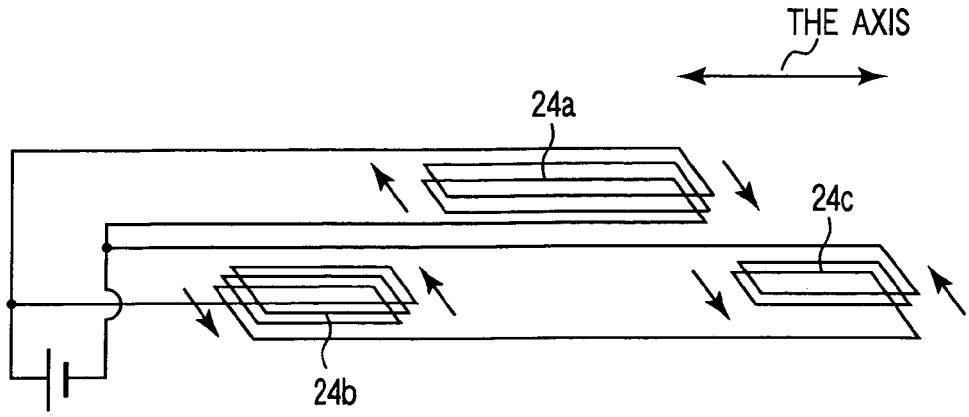
FIG. 3 schematically shows an example of excitation coils that are provided in the heating device shown in FIG. 2.

It is preferable that the excitation coils 24*b* and 24*c*, as is illustrated in FIG. 3, be formed of a single wire in the same winding direction in the state in which they are held between the holders 20*a* and 20*b*. Specifically, it is preferable that the excitation coils 24*b* and 24*c* be disposed such that when the excitation coils 24*b* and 24*c* are connected as shown in FIG. 3 and current is supplied at the same time to the excitation coils 24*a*, 24*b* and 24*c*, the direction of current flowing in the excitation coil 24*b* becomes equal to that of current flowing in the excitation coil 24*c*, the excitation coils 24*b* and 24*c* being adjacent to each other with respect to an axis perpendicular to the axis of the heating roller 2.

Figure 4:
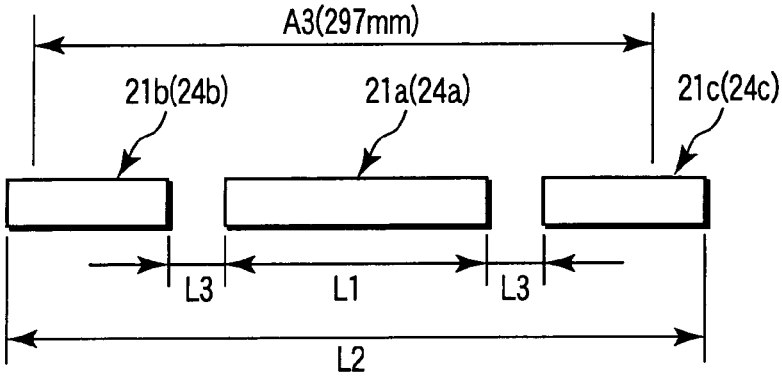
FIG. 4 schematically shows an example of arrangement of excitation coils in the heating device shown in FIG. 2.

As is shown in FIG. 4, the length of the excitation coil 24*a* (central coil) is set at L1 so as to be able to heat at least the region (width) of contact between, e.g. an A4-size sheet and the outer peripheral surface of the roller, when the A4-size sheet is fed with its short side being parallel to the axis of the heating roller 2.

The excitation coils 24*b* and 24*c* (side-end coils) are regarded as a single coil, when they are viewed from the aspect of electrical circuitry. When the excitation coils 24*b* and 24*c* are aligned with the excitation coil 24*a*, as shown in FIG. 4, it is preferable that a longitudinal-axial length L2 between the outside ends of the excitation coils 24*b* and 24*c* be not less than the length of the short side of an A3-size sheet.

The excitation coils 24*a*, 24*b* and 24*c* are arranged at intervals of distance L3. The distance L3 is defined as a distance that minimizes non-uniformity in surface temperature of the heating roller 2. The surface temperature of the heating roller 2 varies depending on the size of to-be-heated matter (sheet) that passes through the nip 4 while absorbing a predetermined amount of heat. If the distance L3 is too small, the temperature of a surface region of the heating roller 2, which is located between the adjacent coils, becomes higher than the temperature of the other surface region of the heating roller 2. If the distance L3 is too large, the temperature of the surface region of the heating roller 2, which is located between the adjacent coils, becomes lower than the temperature of the other surface region of the heating roller 2. In short, non-uniformity in temperature occurs. In the present embodiment, the distance L3 is determined, based on actual measurement results, so as to minimize the non-uniformity in surface temperature of the heating roller 2.

Each of the excitation coils 24*a*, 24*b* and 24*c* may be formed of, e.g. litz wire that is composed of a predetermined number of twisted copper wire elements each having an outside diameter of $\phi$=0.5 to 1.0 mm. The wire elements are coated with insulator such as polyimide. In the present embodiment, each coil is designed to be driven with a voltage of, e.g. 100V. For this purpose, litz wire, which is composed of 19 copper wire elements each having an outside diameter of $\phi$=0.5 mm, is used.

As will be described later with reference to FIG. 5, each coil is supplied with a voltage and current of a predetermined resonance frequency, thereby generating a predetermined magnetic field. Consequently, eddy current occurs at predetermined portions of the heating roller 2. Joule heat is produced by the eddy current and the resistance of the heating roller. As a result, the heating roller 2 is heated.

Figure 5:
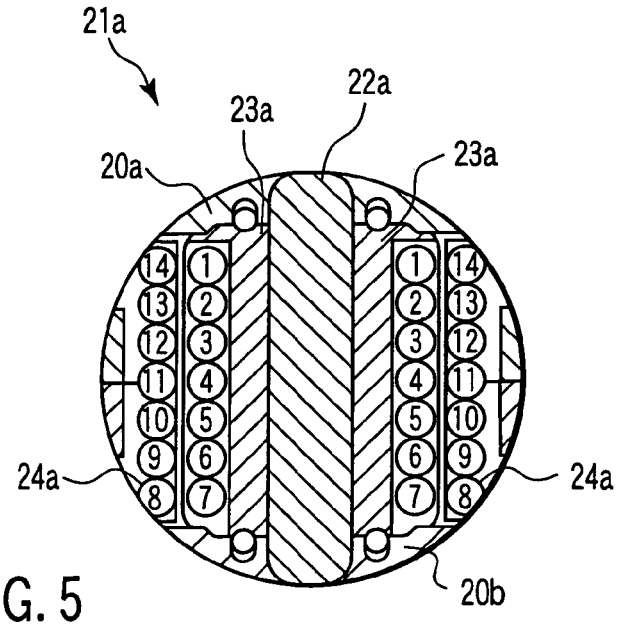
FIG. 5 is a cross-sectional view of the heating device shown in FIG. 2.

FIG. 5 is a schematic cross-sectional view of the coil unit 21*a*, which is taken along a line perpendicular to the axis of the magnetic field generating means shown in FIG. 2.

In this embodiment, the excitation coil 24*a* is wound, as shown in FIG. 5. Specifically, when the excitation coil 24*a* is divided into two parts on both sides of the core member 22*a*, as shown in the cross section of FIG. 5, the wire of the coil 24*a* is wound around the coil bobbin 23*a* in a direction perpendicular to the sheet surface of FIG. 5. A first layer of winding of the coil unit 21*a* comprises seven turns (1 to 7) and a second layer of winding comprises seven turns (8 to 14). In total, the coil unit 21*a* comprises 14 turns.

Figure 6:
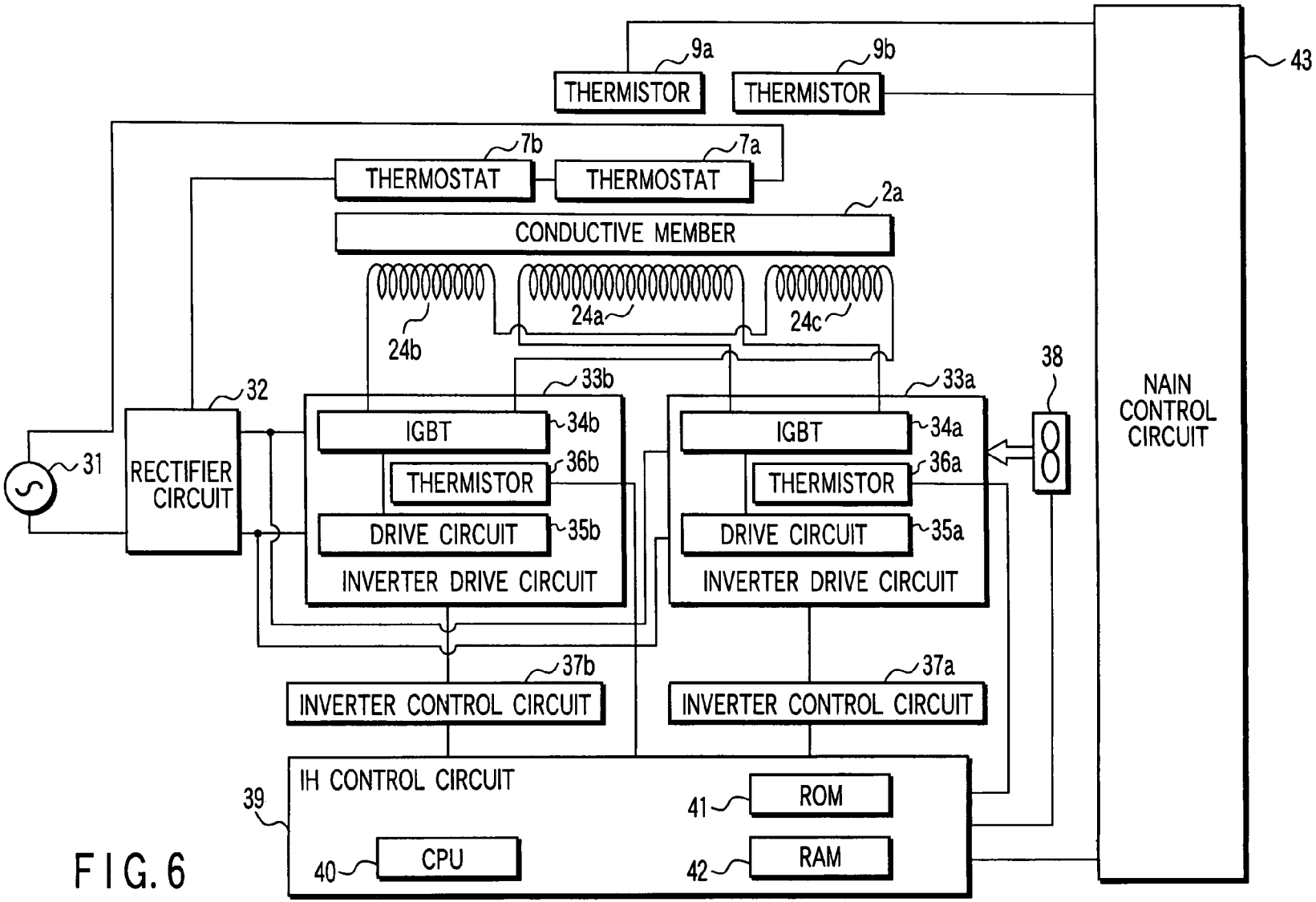
FIG. 6 is a block diagram for illustrating a control system for the heating device shown in FIG. 2.

FIG. 6 is a block diagram illustrating an example of a control system for the fixing device 1 shown in FIG. 1.

A power supply 31 is connected in series to the thermostats 7*a* and 7*b*. The power supply 31 is also connected to two inverter drive circuits 33*a* and 33*b* via a rectifier circuit 32.

The inverter drive circuit 33*a* is connected to the excitation coil 24*a*. The inverter drive circuit 33*b* is connected to the excitation coils 24*b* and 24*c*. The inverter drive circuits 33*a* and 33*b* supply predetermined radio-frequency outputs (current and voltage) to the associated excitation coils. The inverter drive circuit 33*a* includes a switching element 34*a*, a drive circuit 35*a* and a thermistor 36*a*. The inverter drive circuit 33*b* includes a switching element 34*b*, a drive circuit 35*b* and a thermistor 36*b*.

Each of the switching elements 34*a* and 34*b* comprises, for instance, an IGBT (Insulated Gate Bipolar Transistor), and controls an operation of turning on/off a radio-frequency output (radio-frequency current) that is to be supplied to the excitation coil 24*a*, 24*b*, 24*c*.

The drive circuits 35*a* and 35*b* control operations of turning on/off the IGBTs 34*a* and 34*b*. Specifically, each drive circuit 35*a*, 35*b* outputs to the IGBT 34*a*, 35*b* a control-signal (representative of the number of times of switching) for supplying a predetermined output to the associated excitation coil 24*a*, 24*b*, 24*c*.

The thermistor 36*a*, 36*b* is disposed near the IGBT 34*a*, 34*b* and senses the ambient temperature. A fan 38 may be disposed near the IGBT 34*a*, 34*b*. The IGBT 34*a*, 34*b* feeds back ambient temperature information that is sensed by the thermistor 36*a*, 36*b*, thereby instructing the fan 38 to send air. This prevents the IGBT 34*a*, 34*b* from being excessively heated up to high temperatures.

The inverter drive circuit 33*a* is connected to an inverter control circuit 37*a*, and the inverter drive circuit 33*b* is connected to an inverter control circuit 37*b*.

The inverter control circuit 37*a*, 37*b* performs the following drive operation control. For example, the inverter control circuit 37*a*, 37*b* instructs production of a radio-frequency output from the IGBT 34*a*, 34*b*. In other words, the inverter control circuit 37*a*, 37*b* instructs the duration of on-state time of the IGBT 34*a*, 34*b*, so that each coil 24*a*, 24*b*, 24*c* can produce a predetermined heating power output. To be more specific, the inverter control circuit 37*a*, 37*b* instructs the number of times of turn-on (drive frequency) of the IGBT 34*a*, 34*b* per unit time. In this embodiment, assume that a radio-frequency power (current and voltage) in a range of 20.05 to 100 kHz is supplied to the excitation coil 24*a*, 24*b*, 24*c* by using the IGBT 34*a*, 34*b*, or by varying the inductance of the excitation coil 24*a*, 24*b*, 24*c* by a predetermined value. The frequencies within this range are used for induction heating (IH). The frequency of power that is supplied to the excitation coils is set at 20.05 kHz, in consideration of the technical requirements (Radio Law Enforcement Regulations) for approval of type designation of new-type copying machines. However, the frequency may be set at 20 kHz or thereabouts.

The thermistors 36*a* and 36*b*, inverter control circuits 37*a* and 37*b* and fan 38 are connected to an IH control circuit 39. The IH control circuit 39 controls the operations of these components.

The IH control circuit 39 includes a CPU 40, a ROM 41 and a RAM 42.

Based on a prescribed program stored in the ROM 41, the CPU 40 performs a control (hereinafter referred to as "induction heating (IH) control") for causing the excitation coil 24*a*, 24*b*, 24*c* to produce a predetermined heating power, i.e. a coil output. The IH control circuit 39 informs the inverter control circuits 37*a* and 37*b* of a first frequency f1 to be supplied to the excitation coil 21*a* and a second frequency f2 to be supplied to the excitation coils 21*b* and 21*c*, respectively. It is thus possible to set the magnitude of magnetic field, i.e. heating power, at a desired level, which is output from each excitation coil. Based on the heating power, eddy current is generated in the heating roller 2, thereby to ensure a predetermined image-fixing temperature (i.e. temperature for fixing a developed toner image on paper). In general, the numerical value of heating power is managed as power consumption of each coil. In the description below, it is assumed that the coil output (power consumption) of each coil is a power that is simply input to the excitation coil.

The RAM 42 can store data necessary for induction heating control.

The IH control circuit 39 may be included in a main control circuit 43 that controls the entirety of the fixing device.

The main control circuit 43 is connected to the thermistors 9*a* and 9*b*. Based on a feedback control, the main control circuit 43 manages the IH control circuit 39 so that the surface temperature of the heating roller 2 may be kept uniform in its axial direction.

The power that is supplied from the rectifier circuit 32 to a given one, or all, of the coils may be monitored at all times by detecting the supplied current and voltage by means of a power detection circuit (not shown). The power detection circuit is provided, for example, between the rectifier circuit 32 and the input terminal of the commercial power supply 31, or between the rectifier circuit 31 and the inverter drive circuit 33*a*, 33*b*. An output from the power detection circuit may be delivered to the main control circuit 43. Thereby, a result of the monitoring by the power detection circuit is fed back to the inverter control circuit 37*a*, 37*b* at predetermined timing, and abnormality such as burnout of the inverter drive circuit 33*a*, 33*b* can be detected.

The surface temperature of the heating roller 2 can be maintained at a fixed value in its axial direction by supplying a predetermined power of a predetermined frequency to the excitation coil 24*a*, 24*b*, 24*c* at a predetermined timing, using control methods that will be described below.

Examples of a control (IH control) for raising the outer peripheral surface temperature of the heating roller 2 up to a predetermined level are described.

(First Method)

A first method is described. The temperature detected by the thermistor 9*a*, which is disposed at a position opposed to the central coil unit 21*a*, is compared with the temperature detected by the thermistor 9*b*, which is disposed at a position opposed to at least one of the end-side coil units 21*b* and 21*c*. Based on the comparison result, a predetermined power is supplied to the central coil or the end-side coil at a predetermined time-duration ratio. In short, in the first method, the coil to be turned on at a predetermined duty ratio is switched in an alternate manner. The central and end-side coils, which are supplied with predetermined power at predetermined timing, generate magnetic fields so as to make the surface temperature of the heating roller 2 uniform in its axial direction.

In this case, the width of the end-side coil 24*b*, 24*c* (i.e. the length of end-side coil 24*b*, 24*c* in the axial direction of heating roller 2), over which wire is wound, is less than that of the central coil 24*a*. Thus, there is such a problem that even if the wire is wound around the end-side coil 24*b*, 24*c* in the same manner with the same number of turns as shown in FIG. 5, the same performance cannot be obtained.

For example, assume that the central coil 24*a* and end-side coils 24*b* and 24*c* are formed with such numbers of turns that these coils have the same value of inductance (L), which is a characteristics value of coils. In this case, however, the impedance (Z), which is another characteristic value of coils, differs between the coils. Consequently, the impedance of the end-side coil 24*b*, 24*c* is low. This problem is alleviated by using coil bobbins as shown in FIGS. 7A and 7B.

Figure 7A:
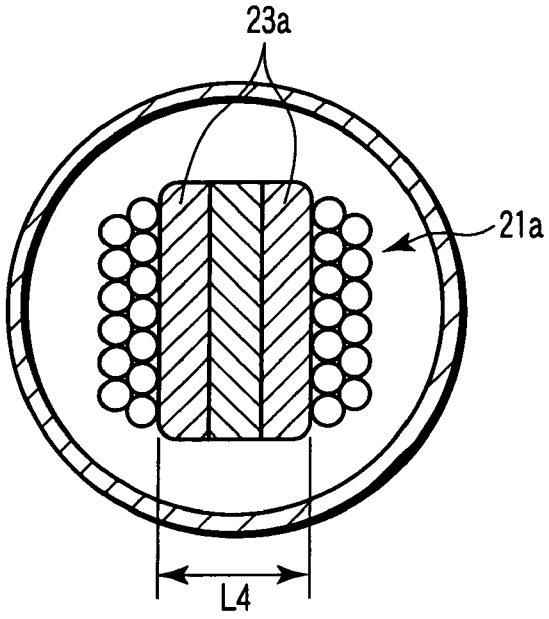
FIG. 7A and FIG. 7B are schematic cross-sectional views of the heating device shown in FIG. 2.
Figure 7B:
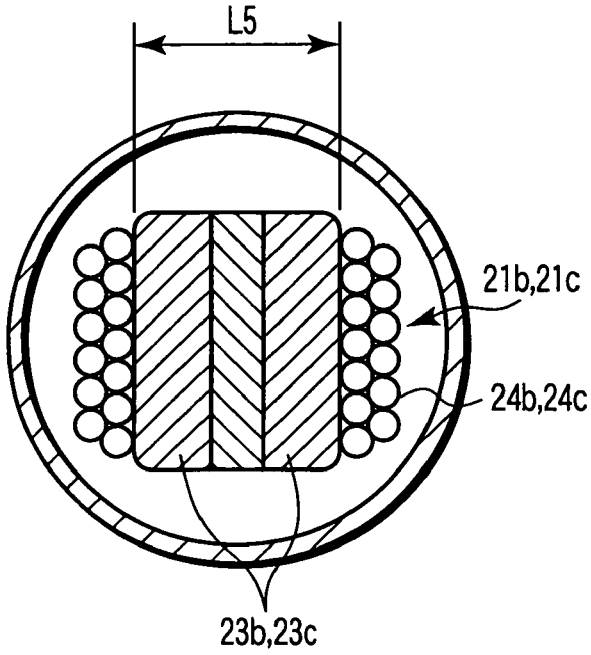

FIG. 7A shows a central coil unit 21*a*, and FIG. 7B shows an end-side coil unit 21*b*, 21*c*.

As is shown in FIGS. 7A and 7B, the length L5 of the coil bobbin 23*b*, 23*c* of the end-side coil unit 21*b*, 21*c* is made greater than the length L4 of the coil bobbin 23 of the central coil unit 21*a*. Thereby, the distance between the coil 24*b*, 24*c* of the end-side coil unit 21*b*, 21*c* and the inner peripheral surface of the heating roller 2 is decreased. Hence, magnetical association between the heating roller 2 and excitation coil 24*b*, 24*c* is enhanced, and the density of magnetic flux acting on the heating roller 2 increases. Therefore, the performance of the end-side coil unit 21*b*, 21*c* is improved.

(Second Method)

A second method is described. A power to the central coil unit 21*a* and a power to the side-end coil unit 21*b*, 21*c* are supplied at the same time with equal values or different values. Thereby, predetermined magnetic fields are generated so as to make the temperature of the heating roller 2 uniform in its axial direction.

However, if electric powers of the same frequency are supplied at the same time to the excitation coils 24*a*, 24*b* and 24*c*, adjacent ones of them resonate, and a problem of resonance noise arises.

Two methods (2-1) and (2-2) are applicable in order to address this problem.

According to the method (2-1), the central coil 24*a* and end-side coil 24*b*, 24*c* are formed with such predetermined numbers of turns such that the central coil 24*a* and end-side coil 4*b*, 24*c* may have inductance (L) values, a difference between which is relatively large. Thereby, even if the same power is supplied to both coils at the same time, that is, even if electric powers output from the inverter drive circuits 33 a and 33*b* shown in FIG. 6 have the same frequency, a predetermined difference is present between the frequency of power (i.e. used frequency) supplied to the central coil and the frequency of power supplied to the side-end coil. Therefore, resonance between adjacent coils can be prevented.

In the method (2-2), the values of electric powers that are supplied to the central coil 24*a* and end-side coil 24*b*, 24*c* are varied, thereby providing a predetermined difference between frequencies (used frequencies) of powers that are supplied to both coils. Thus, resonance between the coils can be prevented. Specifically, the inverter drive circuits 33*a* and 33*b* shown in FIG. 6 produce powers with frequencies having a predetermined difference.

The values of inductance of both coils in the method (2-1) and the difference in power to be supplied to both coils in the method (2-2) can be determined, as desired, within such a range that no resonance occurs, for example, within a range in which a difference of 10 kHz or more is provided between the frequencies of powers that are to be supplied to both coils. The range in which no resonance occurs is determined by the characteristics of adjacent coils, power supplied to the coils, control methods for power supply to coils, etc. This range is defined by actual measurement and, needless to say, it is not limited to the above-mentioned value.

In a case where the coil conductances of the central coil and end-side coil are set to be equal, the impedance may be made different.

The above-described IH control methods may be selectively adopted, depending on the operation mode, whereby the heating roller 2 can more effectively be heated uniformly in its axial direction.

For example, the first method may be adopted in the case where the heating roller 2 is heated in a state without thermal hysteresis, that is, when it is heated from normal temperature to a predetermined temperature, typically at a time of warming-up (W/U). Thus, the heating roller 2 can more effectively be heated uniformly in its axial direction.

The second method is advantageously adopted when the non-uniformity in temperature in the axial direction of the heating roller 2 is to be minimized in the state in which the heating roller 2 is already heated to a predetermined temperature, typically at a time of an ordinary copying operation.

Even where the power (current and voltage) with radio frequencies in the range of 20.05 to 100 kHz is used as in the present embodiment, the use of the above-described methods can prevent resonance between adjacent coils, or between a coil and an adjacent component (e.g. coil bobbin, magnetic core), and can alleviate the problem of resonance noise.

Next, the excitation coils 24*a*, 24*b* and 24*c* are described in greater detail.

The excitation coils 24*a*, 24*b* and 24*c* are configured to have characteristic frequencies that differ from the range of frequencies used.

Resonance occurs if the characteristic frequency of the excitation coil 24*a*, 24*b*, 24*c* coincides with an integer number of times of the used frequency. It is thus desirable that the characteristic frequency of the excitation coil 24*a*, 24*b*, 24*c* be set at a predetermined frequency that differs from an integer number of times of each of the frequencies that are used most frequently.

In the present embodiment, the frequencies that are used most frequently are those used in the warming-up (W/U) operation mode, copy operation mode and ready operation mode, which are about 38 kHz, 30 kHz and 25 kHz, respectively. Hence, the characteristic frequencies of the excitation coils 24*a*, 24*b* and 24*c* are neither frequencies near the used frequencies, 38 kHz, 30 kHz and 25 kHz, nor frequencies near 75 kHz, 60 kHz and 50 kHz that correspond to an integer number of times of the used frequencies.

Experimental results with the use of the excitation coils 24*a*, 24*b* and 24*c* demonstrate that resonance noise (dB) decreased by about 50%, compared to the prior art.

Figure 8:
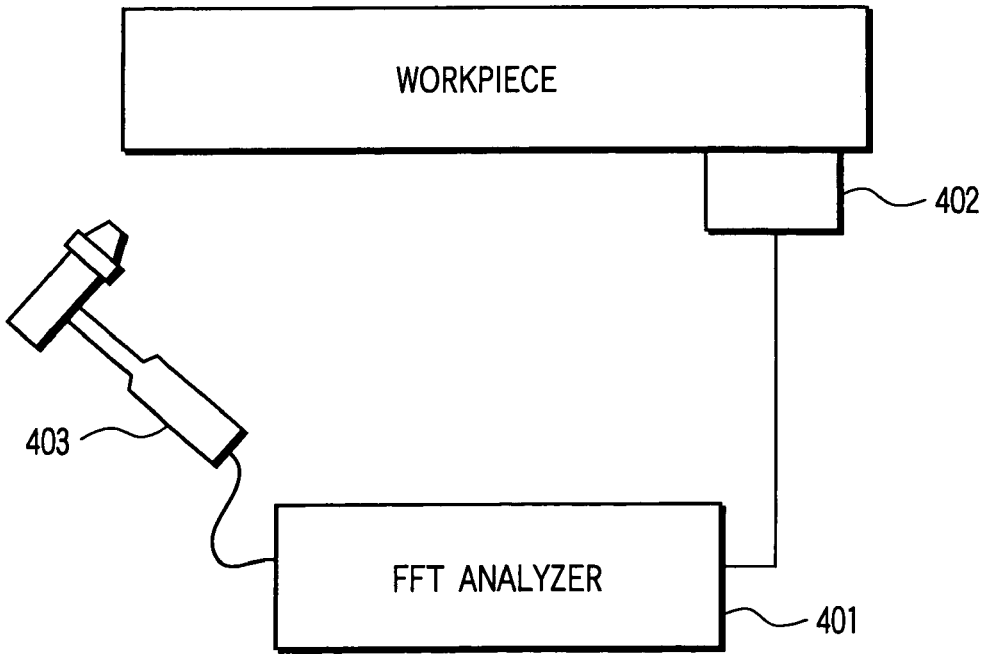
FIG. 8 is a schematic view for illustrating an example of the method of measuring a characteristic frequency.

The characteristic frequency of the excitation coil 24*a*, 24*b*, 24*c* can be measured using measuring equipment, for example, as shown in FIG. 8.

An FFT (fast Fourier transform) analyzer 401 is connected to an acceleration pickup 402 that is coupled to a workpiece, and to an oscillation transmitter 403 that transmits oscillation to the workpiece.

If predetermined oscillation is transmitted from the oscillation transmitter 403 to the workpiece, the FFT analyzer 401 acquires information on the magnitude of the oscillation, and can measure the oscillation of the workpiece on the basis of a signal from the acceleration pickup 402.

Using this equipment, the characteristic frequency of the excitation coil 24*a*, 24*b*, 24*c* can properly be set.

In the present embodiment, an Impulse Hammer (manufactured by Kabushiki-Kaisha Ono-Sokki Seizo) was used as the oscillation transmitter.

Even where the power (current and voltage) with radio frequencies in the range of 20.05 to 100 kHz is used as in the present embodiment, it is possible to prevent resonance between adjacent coils, and the problem of resonance noise. Therefore, damage to the coil bobbin or core member can be avoided.

Next, the core member 22*a*, 22*b*, 22*c* are described in greater detail.

The core members 22*a*, 22*b* and 22*c* are configured to have characteristic frequencies that are different from the range of used frequencies.

It is desirable, as mentioned above, that the characteristic frequency of the core member 22*a*, 22*b*, 22*c* be set at a predetermined frequency that differs from an integer number of times of each of the frequencies that are used most frequently.

Figure 9:
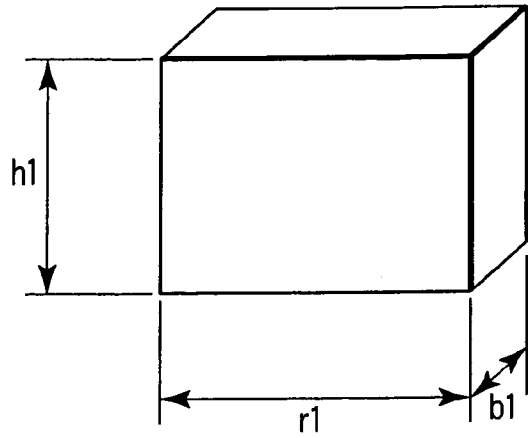
FIG. 9, FIG. 10 and FIG. 11 show examples of a core member in the present invention.

FIG. 9 shows the core member 22*a*, 22*b*, 22*c* with a three-dimensional rectangular shape. As shown in FIG. 9, the core member has a rectangular body with rectangular surface having a dimension h1 on one side and a dimension r1 on the other side, and a dimension b1 in a direction perpendicular to the rectangular surface.

The characteristic frequency ($\omega_n$) of the core member 22*a*, 22*b*, 22*c* is calculated as follows.

The characteristic frequency is expressed by $$\omega_n = \sqrt{\frac{35k}{17m}} \tag{1}$$

where $$k = \frac{48 \cdot E \cdot I1}{r1^3} = \frac{4 \cdot E \cdot b1 \cdot (h1)^3}{r1^3} \tag{2}$$

$$r1 = \frac{b1 \cdot (h1)^3}{12}. \tag{3}$$

The core mass $m$ is given by $$m = \frac{b1 \cdot h1 \cdot r1 \cdot D}{g}. \tag{4}$$

If equations 2, 3 and 4 are substituted, the following equation 5 is obtained:

$$\omega_n = \sqrt{\frac{35 \cdot 4 \cdot g \cdot E \cdot (h1)^2}{17 \cdot D \cdot (r1)^4}} \tag{5}$$

where g (acceleration)=9.8 (m/s2)=9.8×104 (mm/s2),

E (core longitudinal elastic coefficient)=1.0 (1.0 to 2.0)×10−4 (Kgf/mm$^2$), and D (core density)=5.0 (g/cm$^3$)=5.0×10−6 (Kg/mm3).

As described above, the core longitudinal elastic coefficient E includes a factor of frequency. Based on equation 5, in order to obtain the characteristic frequency of the core member 22*a*, 22*b*, 22*c* in this embodiment, which excludes the range of used frequencies, f=20.05 to 100 (kHz), the core member needs to meet the range of sizes defined by the following formula.

$$\frac{h1}{r1^2} < 2.7 \qquad \frac{h1}{r1^2} > 6.3. \tag{6}$$

Thus, if the core member 22*a*, 22*b*, 22*c* is formed to have the shape that meets formula 6, which is defined based on the used frequencies, it is possible to prevent resonance between adjacent coils, the problem of resonance noise, and damage to the coil bobbin or core member.

For example, the core member, which has a size of h1=50 mm, r1=24 mm and b1=10 mm, meets the formula 6 since h1/r1$^2$=0.086.

In addition, the core member, which has a size of h1=50 mm, r1=28 mm and b1=10 mm, meets the formula 6 since h1/r1$^2$=0.063.

In the present invention, the shape of the core member is not limited to the rectangular shape. Alternatively, the invention is applicable to an E-shaped or T-shaped core member.

Figure 10:
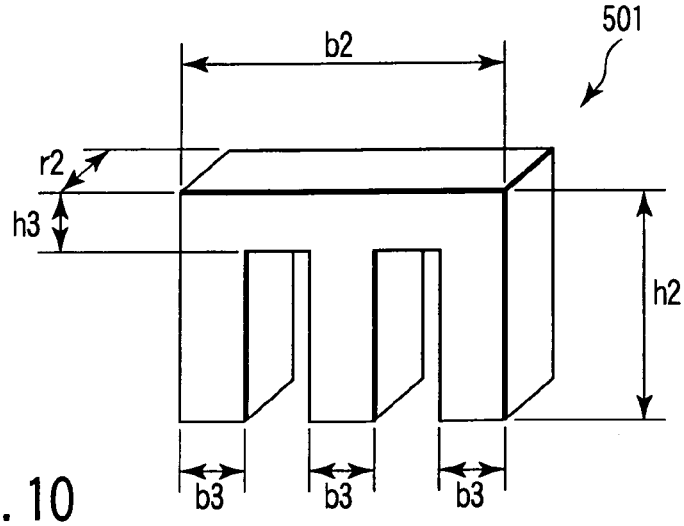
Figure 11:
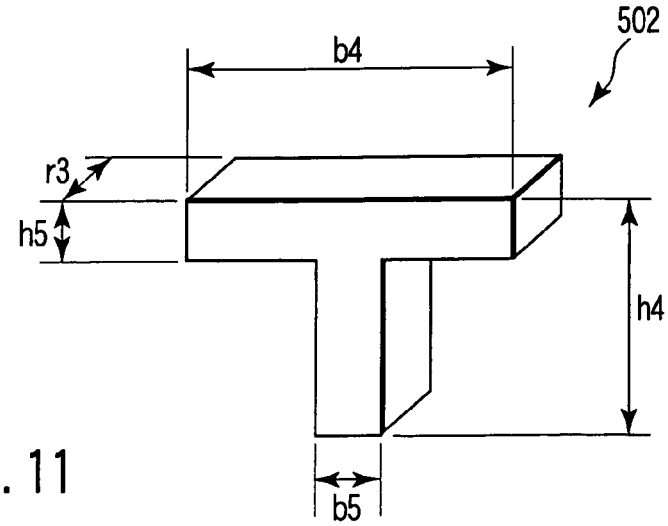

FIG. 10 is a cross-sectional view of an E-shaped core member 501, and FIG. 11 is a cross-sectional view of a T-shaped core member 502.

The core member 501, as shown in FIG. 10, comprises three juxtaposed parallel portions and a perpendicular portion that is couples the three parallel portions in a direction perpendicular to the axis of each parallel portion. The perpendicular portion has a length b2 and a width h3. Each parallel portion has a width b3. The sum of the length of each parallel portion and the width h3 of the perpendicular portion is h2. Each of the parallel portions and perpendicular portion (core member 501) has a thickness r2.

In this case, equation 3 is changed to $$r2 = \frac{b \cdot h^3 - (b - 3 \cdot b1)(bh - h1)^3}{12}. \tag{7}$$

Substituting equations 2, 4 and 7 in equation 1, the characteristic frequency of the core member 501 is calculated. In order for the thus calculated characteristic frequency to fall within ranges, which exclude the range of frequencies, f=20.05 to 100 (kHz), used in this embodiment, the core member 501 is formed to have a predetermined size.

Similarly, with respect to the core member 502, equation 3 is changed to $$r3 = \frac{b \cdot h^3 - (b - b1)(h - h1)^3}{12}. \tag{8}$$

Substituting equations 2, 4 and 8 in equation 1, the characteristic frequency of the core member 502 is calculated.

The core member 502 comprises a first core portion and a second core portion that is coupled perpendicular to the first core portion. The first core portion has a length b4 and a width h4. The second core portion has a width b5. The sum of the length of the second core portion and the width h5 of the first core portion is h4. Each of the first and second core portions (core member 502) has a thickness r3.

In order for the thus calculated characteristic frequency to fall within ranges, which exclude the range of frequencies, f=20.05 to 100 (kHz), used in this embodiment, the core member 502 is formed to have a predetermined size.

As has been described above, in the present invention, the excitation coil and/or core member, which has a characteristic frequency other than the used frequencies, is used. Thereby, resonance is prevented between adjacent coils or between a coil and an adjacent component such as a core member. Needless to say, the present invention is applicable to devices other than the above-described embodiments. Besides, using the above-described first and second control methods, resonance can more effectively be prevented.

What is claimed is:

1. A heating device comprising:

a coil that is supplied with predetermined power and generates a predetermined magnetic field;

a core member with a predetermined characteristic frequency, the core member being disposed near the coil;

a control section that supplies power with a frequency within a range of 20.05 to 100 kHz to the coil; and an electrically conductive member that produces heat by a magnetic field that is generated by the coil, which is supplied with the power having a frequency within the range of 20.05 to 100 kHz, from the control section, wherein the predetermined characteristic frequency of the core member differs from the range of frequencies of the power that are output from the control section and;

the core member is a three-dimensional rectangular body with rectangular surface having a dimension r on one side and a dimension h on another side, the shape meeting the following condition, $h/r^2 < 2.7$, or $h/r^2 < 6.3$.

2. The heating device according to claim 1, wherein the core member is formed of a magnetic body.

3. The heating device according to claim 1, wherein the coil comprises a first coil and a second coil, the first coil being disposed closer to the electrically conductive member than the second coil.

4. The heating device according to claim 3, wherein the first coil has a lower impedance value than the second coil.

5. The heating device according to claim 4, wherein the first coil and the second coil have an equal inductance value.

6. A heating device comprising:

means for generating magnetic field which is supplied with predetermined power and generates a predetermined magnetic field;

means for intensifying magnetic coupling with a predetermined characteristic frequency, the intensifying means being disposed near the generating means;

means for supplying power having a frequency within a range of 20.05 to 100 kHz, to the generating means; and means for producing heat by a magnetic field that is generated by the generating means, which is supplied with the power having a frequency within the range of 20.05 to 100 kHz, from the control section, wherein the predetermined characteristic frequency of the generating means differs from the range of frequencies of the power that are output from the supplying means and;

the intensifying means is a three-dimensional rectangular body with rectangular surface having a dimension r on one side and a dimension h on another side, the shape meeting the following condition, $h/r^2 < 2.7$, or $h/r^2 < 6.3$.

7. The heating device according to claim 6, wherein the intensifying means is formed of a magnetic body.

8. The heating device according to claim 6, wherein the generating means comprises a first magnetic field generating means and a second magnetic field generating means, the first magnetic field generating means being disposed closer to the producing means than the second magnetic field generating means.

9. The heating device according to claim 8, wherein the first magnetic field generating means has a lower impedance value than the second magnetic field generating means.

10. The heating device according to claim 9, wherein the first magnetic field generating means and the second magnetic field generating means have an equal inductance value.

* * * * *